US005725999A

United States Patent [19]

Merkel et al.

[11] Patent Number: 5,725,999

[45] Date of Patent: *Mar. 10, 1998

[54] METHINE YELLOW DENSITY CORRECTION DYES FOR COLOR NEGATIVE FILMS WITH MAGNETIC RECORDING LAYERS

[75] Inventors: Paul Barrett Merkel, Victor; Melvin Michael Kestner, Hilton; David Hoke, Rochester, all of N.Y.; Jeffrey Walter Schmoeger, Mishawaka, Ind.

[73] Assignee: Eastman Kodak Company, Rochester, N.Y.

[ * ] Notice: The term of this patent shall not extend beyond the expiration date of Pat. No. 5,719,013.

[21] Appl. No.: 574,510

[22] Filed: Dec. 19, 1995

Related U.S. Application Data

[60] Provisional application No. 60/008,157, Oct. 31, 1995.

[51] Int. Cl.[6] ..... G03C 1/46

[52] U.S. Cl. ..... 430/504; 430/517; 430/522; 430/559; 430/523; 430/524; 430/527; 430/530; 430/961

[58] Field of Search ..... 430/504, 517, 430/522, 559, 523, 524, 527, 530, 961

[56] References Cited

U.S. PATENT DOCUMENTS

| | | | |
|---|---|---|---|
| 4,141,735 | 2/1979 | Schrader et al. | 96/75 |
| 4,316,013 | 2/1982 | Hunt | 542/445 |
| 4,764,455 | 8/1988 | Arakawa et al. | 430/533 |
| 4,840,884 | 6/1989 | Mooberry et al. | 430/557 |
| 4,990,276 | 2/1991 | Bishop et al. | 252/62.54 |
| 5,079,134 | 1/1992 | Toya | 430/522 |
| 5,098,818 | 3/1992 | Ito et al. | 430/522 |
| 5,106,942 | 4/1992 | Krutak et al. | 528/272 |
| 5,147,768 | 9/1992 | Sakakibara | 430/501 |
| 5,213,956 | 5/1993 | Diehl et al. | 430/522 |
| 5,217,804 | 6/1983 | James et al. | 428/329 |
| 5,229,259 | 7/1993 | Yokota | 430/523 |
| 5,252,441 | 10/1993 | James et al. | 430/496 |
| 5,260,179 | 11/1993 | Diehl et al. | 430/517 |
| 5,354,650 | 10/1994 | Southby et al. | 430/955 |
| 5,368,997 | 11/1994 | Kawamoto | 430/533 |
| 5,380,634 | 1/1995 | Kiekens et al. | 430/517 |
| 5,395,743 | 3/1995 | Brick et al. | 430/496 |
| 5,447,819 | 9/1995 | Mooberry et al. | 430/955 |
| 5,455,140 | 10/1995 | Texter et al. | 430/546 |
| 5,455,141 | 10/1995 | Owaczarczyk et al. | 430/359 |
| 5,457,004 | 10/1995 | Mooberry et al. | 430/359 |
| 5,470,688 | 11/1995 | Texter et al. | 430/559 |

FOREIGN PATENT DOCUMENTS

| | | |
|---|---|---|
| 4-040429 | 2/1992 | Japan . |
| 92/21064 | 11/1992 | WIPO . |

*Primary Examiner*—Geraldine Letscher
*Attorney, Agent, or Firm*—Arthur E. Kluegel

[57] ABSTRACT

The invention provides a multilayer color negative photographic element comprising a support, at least one light-sensitive silver halide layer sensitive to each of the blue, green and red regions of the visible spectrum, a magnetic recording layer and a yellow or orange-yellow methine density correction dye of structure I,

I wherein $R_1$ is hydrogen or an alkyl group;

$R_2$ is an alkyl group or an aryl group;

$R_3$ is hydrogen, a halogen atom, an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently a substituent selected from the group consisting of a halogen atom, and alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, alkylthio, arylthio and cyano groups;

$R_1$ and $R_2$ or $R_2$ and $R_3$ may join to form a ring.

The element exhibits improved color balance permitting it to be satisfactorily processed together with conventional photographic elements to produce viewable color images which do not have undesired yellow coloration when some printers are used.

29 Claims, No Drawings

METHINE YELLOW DENSITY CORRECTION DYES FOR COLOR NEGATIVE FILMS WITH MAGNETIC RECORDING LAYERS

CROSS-REFERENCE TO RELATED APPLICATION

This application is a continuation of Provisional application Ser. No. 60/008,157 filed Oct. 31, 1995, now abandoned.

FIELD OF THE INVENTION

This invention relates to color negative photographic materials or elements comprising yellow density correction dyes and transparent magnetic recording layers.

BACKGROUND OF THE INVENTION

Modern color negative films usually contain dyes coated in one or more layers for a variety of purposes. In addition to being utilized for spectral sensitization, dyes may be used for filtration of specific wavelengths of exposing light (either as intergrain absorbers or in separate layers containing no silver halide), for antihalation and to adjust the background density (Dmin) of color negative films for printing purposes. Dyes that are used to adjust Dmin of color negative films to produce prints of proper color balance may be referred to as density correction dyes. However, such dyes may also be used for filtration and/or antihalation purposes.

A recent advance in the structure of color negative films comprises use of magnetic recording layers to encode useful information for printing and other purposes. The magnetic recording layers can contain magnetic particles of a variety of types, sizes and shapes, but are generally designed to be transparent to visible light. Additional descriptions of such magnetic layers may be found, for example, in Research Disclosure, November 1992, Item 34390, p 869 and in U.S. Pat. No. 5,395,743 of Brick et al. Although, the magnetic recording layers are essentially transparent, the magnetic particles and/or the polymeric supports used for color negative films with magnetic recording layers can lead to higher absorption in the far blue region of the visible spectrum (ca 400–440 nm) than is typical for conventional color negative films. The differences in the far blue absorption of conventional films and films containing magnetic recording layers can lead to differences in print color balance when these films are printed together on certain printers.

Many color printers scan the average red, green and blue densities of a color negative and use these readings to automatically adjust exposures for proper density and color balance. The spectral sensitivities of printer scanners often do not match the spectral sensitivities of color papers. While most color papers have peak blue sensitivities in the neighborhood of 480 nm and little sensitivity in the far blue region, some printers, such as the AGFA MSP printer, have considerable blue sensitivity in the region of 400 to 440 nm. When two color negative films having different density ratios at 480 nm vs 400–440 nm are printed together using a printer such as the AGFA MSP, the resulting prints will have different color balance, and the two films are said to be printer incompatible. Since a printer such as the AGFA MSP printer may see different blue densities for a conventional color negative film and a film with a magnetic recording layer, even if the films have the same blue densities in the region of color paper sensitivity, it may expose such films differently leading to unacceptable differences in color balance.

One approach for avoiding color balance problems and maintaining printer compatibility for films containing magnetic recording layers is to incorporate one or more density correction dyes that spectrally compensate for the differences in the far blue absorption of the magnetic film and conventional color negative films. Since films containing magnetic recording layers generally have greater far blue absorption than conventional films, this compensation is most suitably achieved by replacing conventional yellow or orange density correction dyes with one or more yellow dyes having reduced absorption in the region of approximately 400–440 nm. Since some conventional color negative films also contain orange color correction dyes, such as Cl below, that absorb strongly in the region of 480 nm, it may also be desirable to select a single yellow density correction dye with both less absorption in the 400–440 nm region and greater absorption near 480 nm to replace both the conventional yellow and orange density correction dyes. In addition to having these spectral properties, it is desired that the yellow density correction dyes utilized in color negative films with magnetic recording layers be inexpensive, readily dispersible and stable toward heat, moisture and photographic processing chemicals.

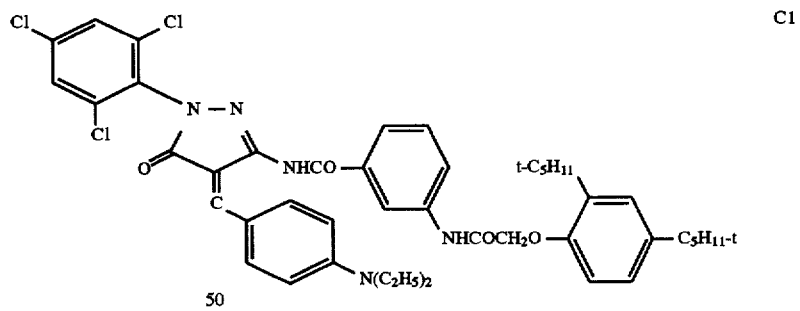

International Patent Application WO92/21064 A1 (EP 540,729 A1) of Mooberry et al discloses photographic elements comprising blocked filter dyes that are designed to unblock and wash out on processing. Among the many blocked dyes disclosed is one blocked cyano benzoxazolyl arylidene dye (16), similar to the density correction dyes of this invention. Unlike the density correction dyes of the present invention, which are designed to be permanent, the blocked dyes of WO 92/21064 A1 are removed on processing. WO 92/21064 A1 does not disclose or suggest combining the density correction dyes of our invention with magnetic particles, nor does it teach the specific spectral properties that are required of such a dye to provide prints of proper color balance when used in color negative films comprising one or more magnetic recording layers. Furthermore, WO 92/21064 A1 does not disclose the most suitable density correction dyes of our invention.

U.S. Pat. No. 4,840,884 of Mooberry and others discloses blocked cyano benzoxazolyl arylidene type methine dyes (Example 4) similar to the density correction dyes of our invention. However, the arylidene nitrogen atom of these dyes is substituted with a group that is outside the scope of our substitutents ($R_1$ or alternatively $R_2$, below).

Japanese Kokai JP04-040429 discloses methine dyes in nonlinear optical recording materials. This disclosure does not pertain to photographic materials or to use of such dyes in combination with magnetic recording layers.

U.S. Pat. No. 5,106,942 (WO91/07915) of Krutak et al discloses cyano benxoxazolyl and cyano benzothiazolyl arylidene type methine dyes attached to polymers, but offers no teaching of the use of such dyes in in photographic elements or with magnetic recording layers or of the structural and spectral properties required to yield printer compatible color negative films comprising magnetic recording layers.

U.S. Pat. No. 4,316,013 (GB 2,077,282) of Hunt discloses cyano benzoxazolyl and cyano benzothiazolyl arylidene type methine dyes for dyeing of synthetic fibers. However, this reference does not teach the use of such dyes in photographic elements or with magnetic recording layers, nor does it or the other art teach, the specific structural and spectral properties of the methine dyes required to yield printer compatible color negative films comprising magnetic recording particles.

There is now a considerable body of art relating to the magnetic recording layers. In addition to the above noted U.S. Pat. No. 5,395,743 and Research Disclosure, November 1992, Item 34390 the following U.S. Pat. Nos. may be relevant: 4,141,735, 4,990,276, 5,147,768, 5,217,804, 5,229,259, 5,252,441, 5,294,437, 5,368,997 and 5,395,743. These patents do not recognize the printing problem created by the addition of a magnetic layer to the film structure.

Accordingly, a problem to be solved is to provide a color negative photographic element containing a magnetic layer, which is capable of being processed at the same time as conventional films which do not contain a magnetic layer, without introducing a yellow coloration into the prints produced form the magnetic layer containing film.

SUMMARY OF THE INVENTION

The invention provides a multilayer color negative photographic element comprising a support, at least one light-sensitive silver halide layer sensitive to each of the blue, green and red regions of the visible spectrum, a magnetic recording layer and a yellow or orange-yellow methine density correction dye of structure I,

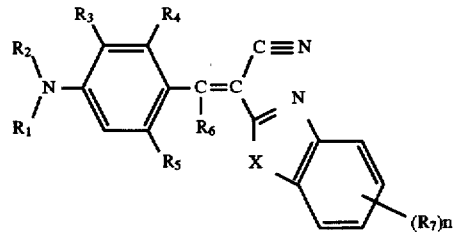

I wherein:

$R_1$ is hydrogen or an alkyl group;

$R_2$ is an alkyl group or an aryl group;

$R_3$ is hydrogen, a halogen atom, an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently a substituent selected from the group consisting of a halogen atom, and alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, alkylthio, arlythio and cyano groups;

n is 0, 1, 2 or 3; and $R_1$ and $R_2$ or $R_2$ and $R_3$ may join to form a ring.

The element exhibits improved color balance permitting it to be satisfactorily processed together with conventional photographic elements to produce viewable color images which do not have undesired yellow coloration when some printers are used.

DETAILED DESCRIPTION OF THE INVENTION

As indicated, this invention relates to color negative photographic materials or elements comprising a yellow methine density correction dye having the generic structure shown in the Summary of the Invention and a magnetic recording layer. The methine density correction dyes of this invention may also function as filter dyes and/or antihalation dyes and may be coated in various layers including a filtration layer between blue and green sensitive layers and an antihalation layer under (further from the exposing light) the light sensitive silver halide layers.

The invention provides color negative films with magnetic recording layers that provide viewable media such as prints having the proper color balance when printed together with conventional (nonmagnetic) color negative films. This means that separate settings or separate processing for the film having the magnetic layer is not required in order to obtain satisfactory prints. The invention also provides thinner color negative films with reduced chemical laydown through the use of high extinction density correction dyes of the proper hue. Further, the density correction dyes of the invention may also serve as filter dyes or antihalation dyes. Moreover, the density correction dyes are easily and inexpensively manufactured and readily dispersible.

The photographic materials of this invention comprise color negative films comprising a support, at least one light-sensitive silver halide layer sensitive to each of the blue, green and red regions of the visible spectrum, one or more magnetic recording layers and one or more yellow or orange-yellow cyano benzoxazolyl or cyano benzothiazolyl arylidene type methine density correction dyes of structure I,

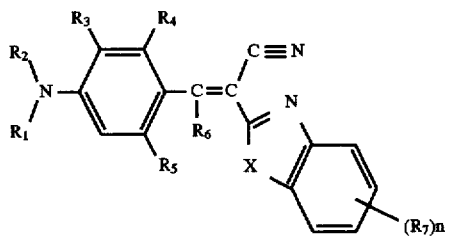

I wherein:

$R_1$ is hydrogen or an alkyl group;

$R_2$ is an alkyl group or an aryl group;

$R_3$ is hydrogen, a halogen atom (such as chlorine or fluorine), an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

$R_7$ is a substituent selected from the group consisting of halogen atoms (such as chlorine or fluorine), alkyl, aryl, alkoxy, aryloxy, carbonamido, sulfonamido, carbamoyl, alkoxycarbonyl, aryloxycarbonyl, acyloxy, acyl, sulfamoyl, sulfonyl, sulfoxyl, alkylthio, arlythio and cyano groups;

n is 0, 1, 2 or 3;

the $R_7$ substituents may be the same or different, when n is 2 or 3; and $R_1$ and $R_2$ or $R_2$ and $R_3$ may join to form a ring.

In one embodiment of this invention $R_1$ is hydrogen. In another embodiment of this invention $R_2$ is an alkyl group. In another embodiment of this invention n is 0, 1 or 2. In a preferred embodiment of this invention $R_4$ is hydrogen. In another preferred embodiment of this invention X is oxygen. In another preferred embodiment of this invention $R_5$ is an alkyl group. In another embodiment of this invention $R_3$ is an alkoxy group. In another preferred embodiment of this invention $R_6$ is hydrogen. In a particularly suitable embodiment of this invention $R_1$ is hydrogen, $R_2$ is alkyl, $R_3$ is hydrogen or alkyl, $R_4$ is hydrogen, $R_5$ is alkyl, $R_6$ is hydrogen, X is oxygen, n is 0 or 1, and $R_7$ is an alkyl group, a sulfonamido group or a halogen atom, such as chlorine, in the para position relative to the oxygen of the benzofuran ring. In another particularly suitable embodiment of this invention $R_1$ and $R_2$ are alkyl groups, $R_3$, $R_4$ and $R_6$ are hydrogen, $R_5$ is an alkyl group, n is 0 or 1 and $R_7$ is an alky group, a sulfonamido group or a halogen in the para position relative to X, which is oxygen.

Useful absorption maxima for the yellow methine dyes of this invention depend upon the spectral band shapes but are in the range of 450–480 nm as coated in the photographic materials of this invention. More suitably, the spectral absorption maxima of the coated yellow methine dyes of this invention are in the range of 455–475 nm. The optimum spectra and laydowns of the density correction dyes of this invention depend upon the support and the nature of the magnetic recording material. Generally it is desired that the density correction dye have high absorption in the spectral region of approximately 440 nm to 480 nm relative to 420 nm and minimal absorption at 510 nm and longer wavelengths. Typically it is desired that the density correction dye provide a density ratio at 480 nm relative to 420 nm of about 1.1 to 3.0, a density ratio at 440 nm relative to 420 nm of about 1.2 to 2.2, and a density ratio at 510 nm relative to 480 nm of less than 0.6. For many commonly-used magnetic recording materials, density ratios at 480 vs 420 nm, at 440 vs 420 nm and at 510 vs 480 nm are preferably between 1.25 and 2.5, between 1.3 and 2.0 and less than 0.55, respectively. Useful coated levels of the density correction dyes of this invention depend upon molecular weight and extinction coefficient, but typically range from 0.005 to 0.16 g/sq m, with levels of 0.011 to 0.11 g/sq m being typical.

The alkyl substituents comprising $R_1$ through $R_7$ may unbranched, branched or cyclic and may be unsubstituted or substituted. The alkoxy groups comprising $R_3$ or $R_7$ may be unbranched or branched and may be substituted or unsubstituted. The aryl groups comprising $R_2$ or $R_7$ and the aryloxy groups comprising $R_3$ or $R_7$ may be unsubstituted or substituted. The carbonamido, sulfonamido, carbamoyl, acyloxy, alkoxycarbonyl and aryloxycarbonyl, acyl, sulfamoyl, sulfonyl, sulfoxyl, alkylthio and arylthio groups comprising $R_7$ may also be further substituted. Any substituent may be chosen for the alkyl, aryl, alkoxy, aryloxy and $R_7$ groups that does not adversely affect the performance of the yellow methine density correction dyes of this invention. Suitable substituents include halogen atoms, such as chlorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy-, aryloxy- and alkylamino-carbonamido groups), carbamoyl groups, carbamoyloxy groups, sulfonamido groups, sulfamoyl groups, alkylthio groups, arylthio groups, sulfoxide groups, sulfonyl groups, sulfonyloxy groups, alkoxysulfonyl groups, aryloxysulfonyl groups, trifluoromethyl groups, cyano groups, imido groups and heterocyclic groups, such as 2-furyl, 3-furyl, 2-thienyl, 1-pyrrolyl, 2-pyrrolyl, 1-imidazolyl and N-succinimidyl groups. The aryl groups comprising $R_2$ and the groups comprising $R_7$ may also be substituted with one or more unbranched, branched or cyclic alkyl groups.

It is also desirable that the yellow methine dyes of this invention have low water solubility and remain in the layer(s) in which they are coated during coating, storage and processing. To help ensure this, the total number of carbon atoms in $R_1$ through $R_7$ taken together is at least 8, and preferably at least 10. In addition, to minimize diffusion and washout, the density correction dyes of this invention do not contain charged groups, such as quaternary ammonium groups, or easily ionizable carboxyl (—COOH) or sulfonate (—$SO_3H$) groups.

The yellow methine dyes of this invention are incorporated in the photographic materials of this invention by first dispersing a dye-containing oil phase in an aqueous phase containing a binder, such as gelatin, and one or more surfactants. The dye-containing dispersion is then coated in the appropriate layer of a multilayer film on a suitable support. The oil phase usually consists of the dye dissolved in one or more high-boiling solvents. This is typically added to an aqueous solution of gelatin and surfactant, which is followed by milling or homogenization of the mixture to disperse the oil phase in the aqueous phase as small particles. Auxiliary solvents (removable by washing or evaporation) such as ethyl acetate or cyclohexanone may also be used in the preparation of such dispersions to facilitate dissolution of the dye in the oil phase. However, some yellow methine dyes of this invention do not require the use of a removable auxiliary solvent for dispersion preparation. The yellow methine dyes of this invention may also be dispersed as solid particle dispersions via ball milling.

Hues of the yellow methine dyes of this invention can be shifted to optimize the spectral properties by choice of high-boiling solvent. High-boiling solvents useful for the practice of this invention include aryl phosphates (e.g. tricresyl phosphate), alkyl phosphates (e.g. trioctyl phosphate), mixed aryl alkyl phosphates (e.g. diphenyl 2-ethylhexyl phosphate), aryl, alkyl or mixed aryl-alkyl, phosphonates, phosphine oxides (e.g. trioctylphosphine oxide), esters of aromatic acids (e.g. dibutyl phthalate), esters of aliphatic acids (e.g. dibutyl sebacate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl) sulfoxide), sulfonamides (e.g. N,N-dibutyl-p-toluenesulfonamide) or hydrocarbons (e.g. dodecylbenzene). Additional high-boiling solvents and auxiliary solvents are noted in Research Disclosure, December 1989, Item 308119, p 993. Useful dye:high-boiling solvent weight ratios range from about 1:0.1 to 1:10, with 1:0.2 to 1:5.0 being preferred. The yellow dyes of this invention may also be dispersed without the use of a permanent high-boiling solvent.

The color negative films of this invention can comprise one or more transparent magnetic recording layers, comprising ferromagnetic particles having a size of at least 20 sq m/g and coated at a level of from $1\times10^4$ to $2\times10^5$ g/m$^3$. The ferromagnetic particles comprise iron oxides such as gamma-$Fe_2O_3$, $Fe_3O_4$, or iron oxides such as gamma-Fe2O3 or Fe3O4 surface treated with Co, Zn, Ni or other metals. The ferromagnetic particles of this invention also comprise chromium dioxides, such as $CrO_2$ or $CrO_2$ with metallic elements such as Li, Na, Sn, Pb, Fe, Co, Ni or Zn in soild solution. The ferromagnetic particles of this invention may also comprise barium ferrites. Ferromagnetic metal particles with a surface oxide coating to improve stability may also be used in accordance with this invention. In addition magnetic oxides with a thicker layer of lower refractive oxide or other material having a lower optical scattering cross-section, as taught in U.S. Pat. Nos. 5,217,804 and 5,252,444, may also be used. Cobalt surface-treated gamma iron oxide is the preferred ferromagnetic recording material for use in accordance with this invention.

On an area basis, useful coated magnetic particle concentrations are between about 0.01 and 0.25 g/sq m, with a range of 0.02 to 0.08 g/sq m being typical for the color negative films of this invention.

The magnetic layer(s) of this invention may also contain abrasive particles comprising nonmagnetic inorganic powders with a Mohs scale hardness of at least 6. Specific examples include, aluminium oxides (such as alpha alumina), tin oxides, $Cr_2O_3$, alpha-$Fe_2O_3$, silicon dioxide, titanium dioxide and silicon carbide. Alpha alumina, tin oxides and mixtures thereof are the preferred abrasives. The tin oxides may be undoped or doped and in the nonconductive or conductive forms.

A wide variety of binders may be used in the magnetic recording layers of this invention, including polyurethane resins and cellulose derivatives. Cellulose esters, such as cellulose acetate, cellulose diacetate, cellulose triacetate, cellulose acetate propionate and cellulose acetate butyrate are particularly preferred binders. Mixtures of cellulose diacetate and cellulose triacetate serve as particularly useful binders in the magnetic recording layers of this invention.

The photographic materials of this invention can be provided with a protective or lubricating layer comprising materials such as silicone oil or carnauba wax over the magnetic recording layer.

Any suitable photographic film support may be employed in the practice of this invention, such as cellulose derivatives (including cellulose diacetate, cellulose triacetate, cellulose acetate propionate and cellulose acetate butyrate), polyamides, polycarbonates, polyesters (such as polyethylene terephthalate and polyethylene naphthalate), polystyrene, polyethylene and polypropylene. Preferred supports for the practice of this invention are polyethylene naphthalate, polyethylene terephthalate and cellulose triacetate.

The yellow density correction dyes of this invention may be coated in the color negative photographic materials of this invention either alone in one or more layers or together with other dyes or addenda in the same layers or layer. The yellow dyes of this invention can be coated in any layer on either side of the support. In one preferred embodiment of this invention the yellow density correction dyes are coated in an antihalation layer under (i.e. furthest from the direction of exposure) the light-sensitive silver halide layers. The antihalation layer is often adjacent to the transparent support. The yellow dyes of this invention may also be coated between the green-sensitive and red-sensitive layers of the color negative films of this invention. In another preferred embodiment, the yellow dyes of this invention are coated in a filtration layer under the blue-sensitive layer(s) and over the green sensitive layer(s) of the color negative film. This reduces unwanted blue exposure of the green-sensitive layers and can allow removal of some or all of normally used filtration materials, such as bleachable yellow dyes or Carey-Lea Silver. The yellow dyes of this invention may also be coated above the blue sensitive layer(s) of the color negative films for adjustment of blue speed. The yellow dyes of this invention may also be coated in an emulsion-containing layer such as the least-sensitive magenta dye forming layer.

Examples of nondiffusible yellow methine density correction dyes of this invention include, but are not limited to, the following (D1–D35):

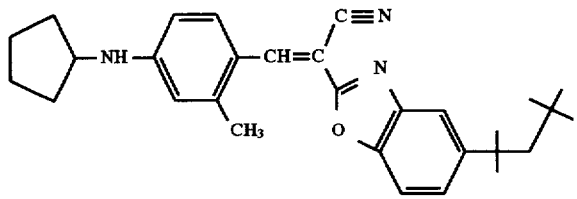

D1

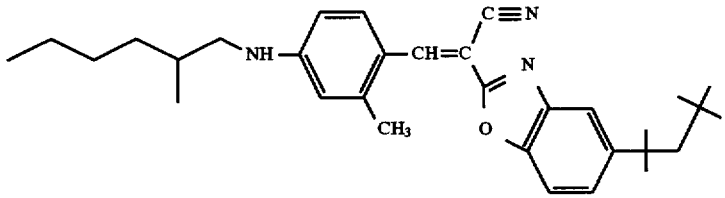

D2

-continued
D3
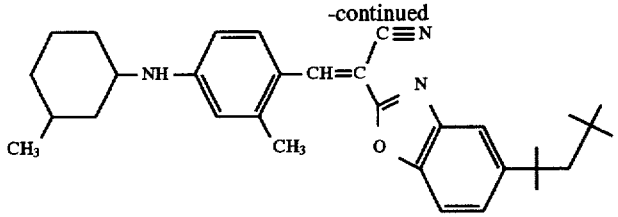
D4
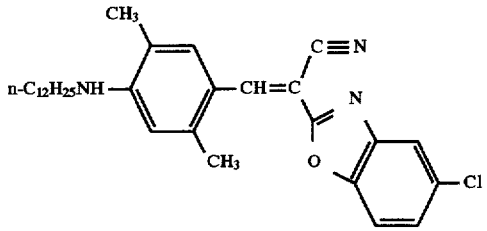
D5
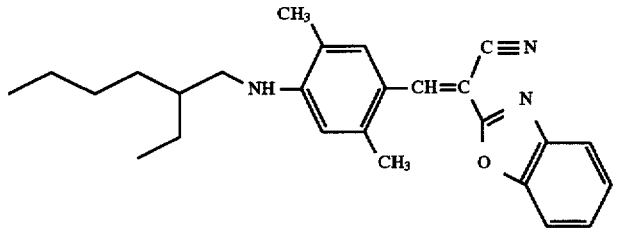
D6
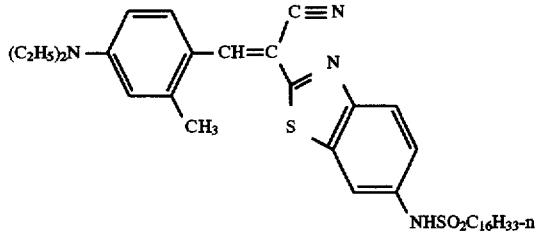
D7
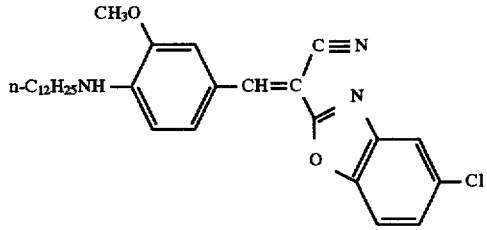
D8
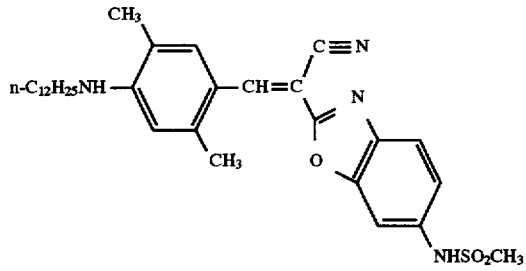
D9
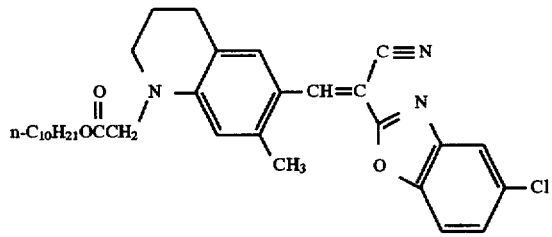

-continued
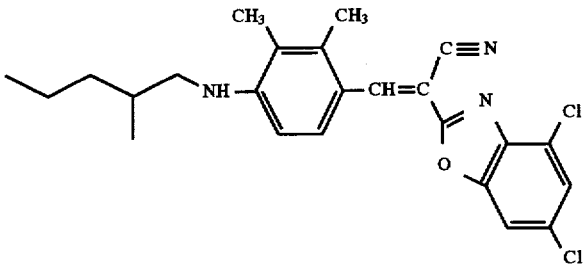
10
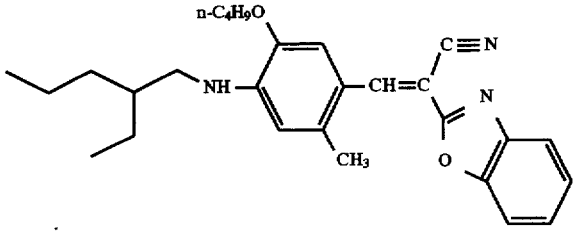
D11
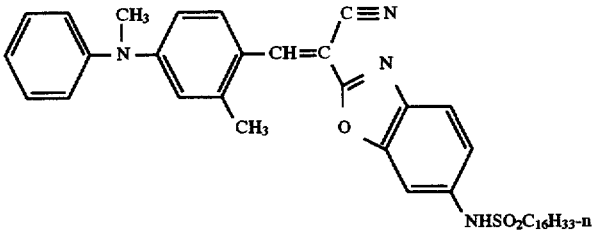
D12
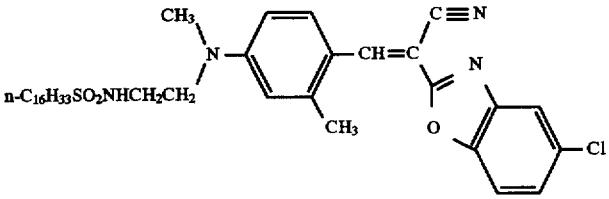
D13
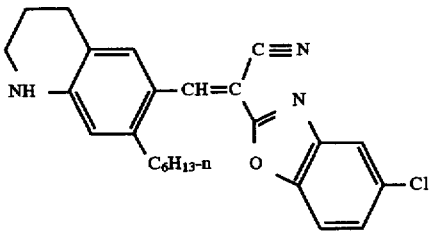
D14
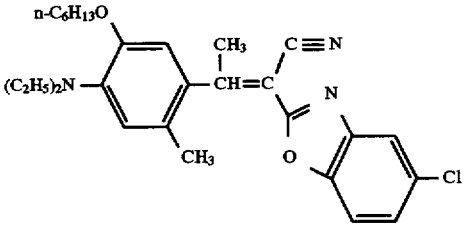
D15
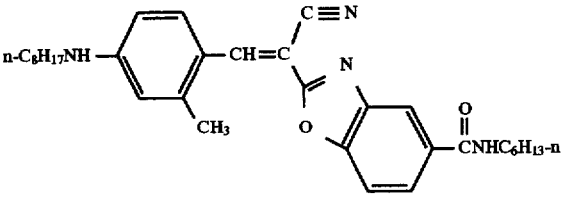
D16

-continued
D17
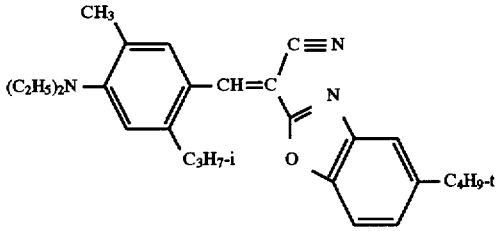
D18
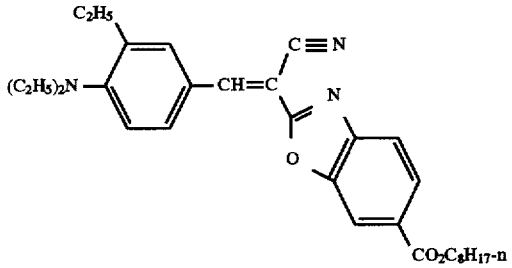
D19
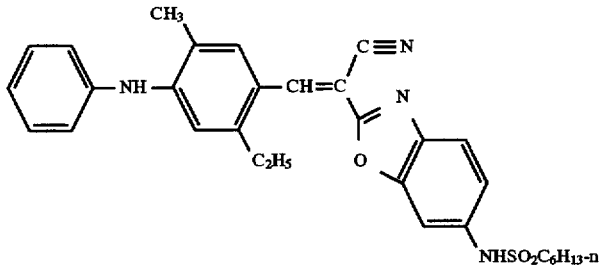
D20
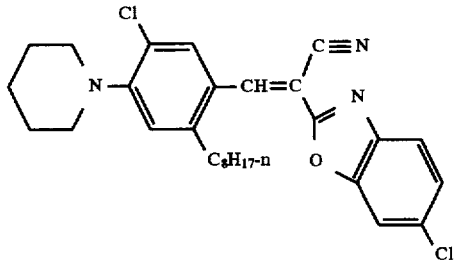
D21
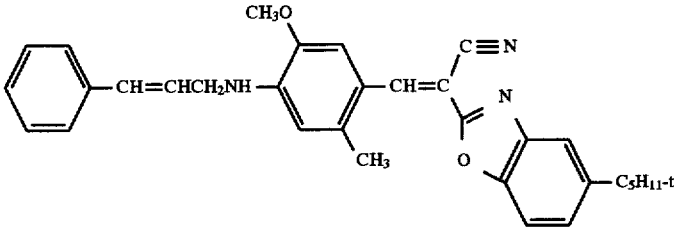
D22
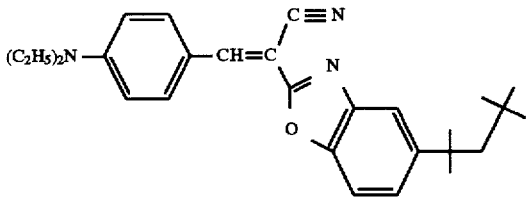

-continued
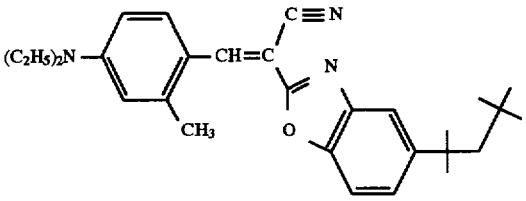
D23
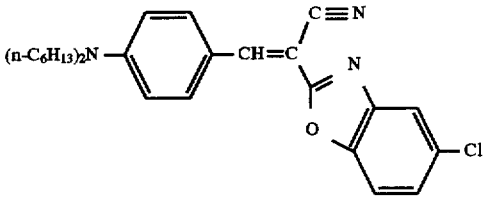
D24
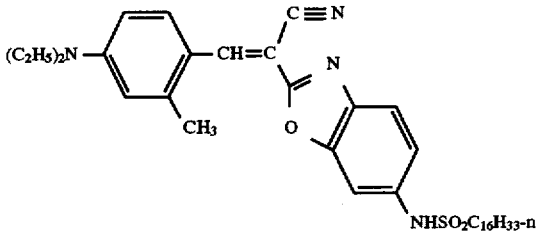
D25
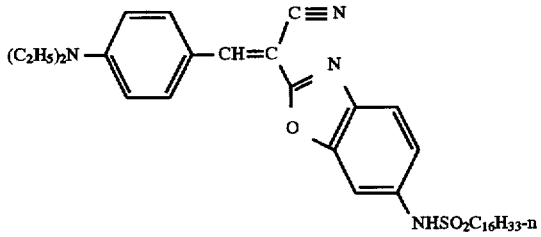
D26
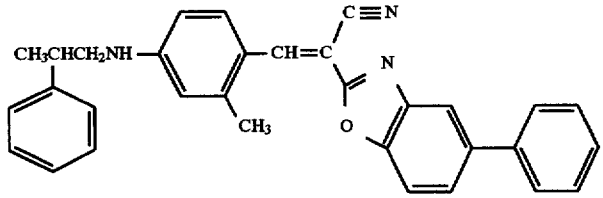
D27
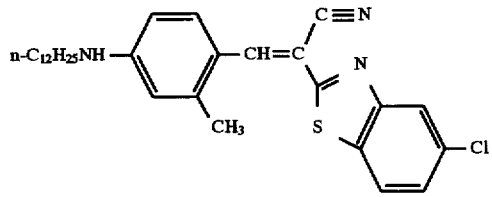
D28
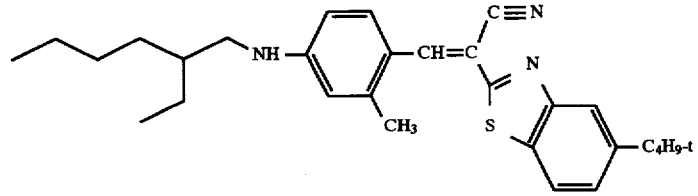
D29

-continued

D30

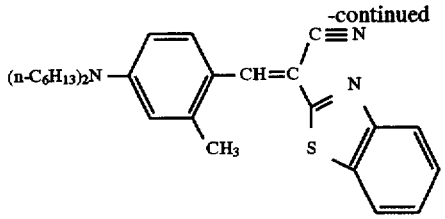

D31

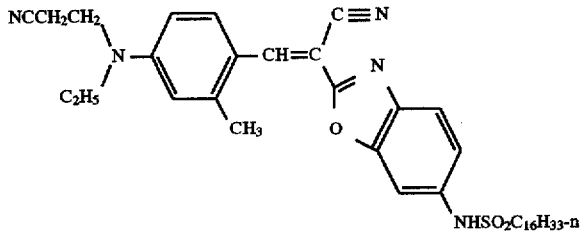

D32

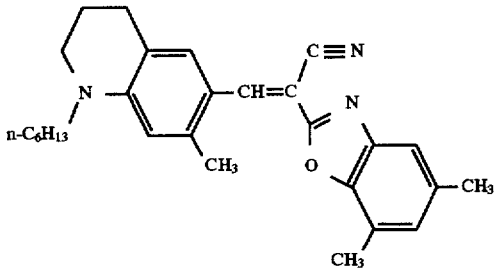

D33

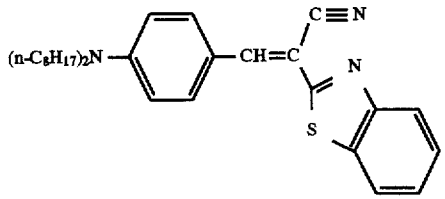

D34

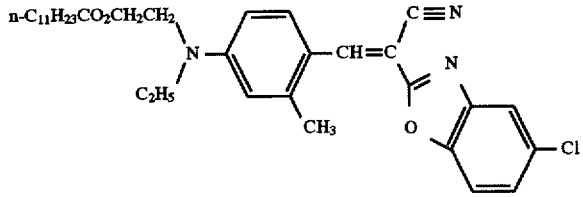

D35

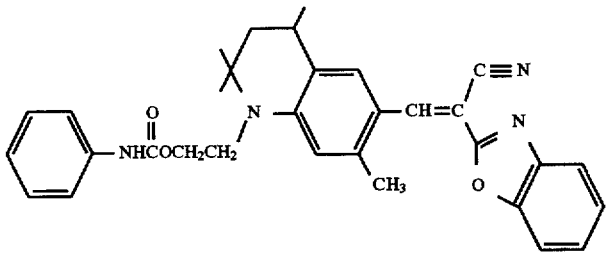

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element.

Multicolor elements contain image dye-forming units sensitive to each of the three primary regions of the spectrum. Each unit can comprise multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

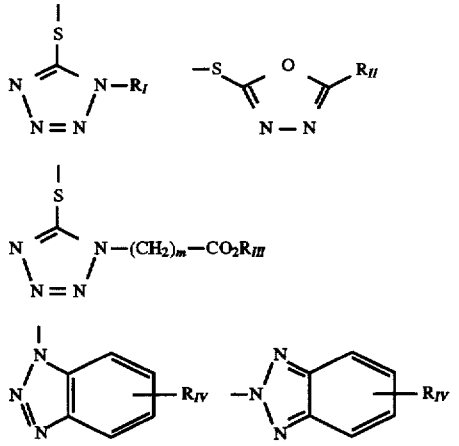

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

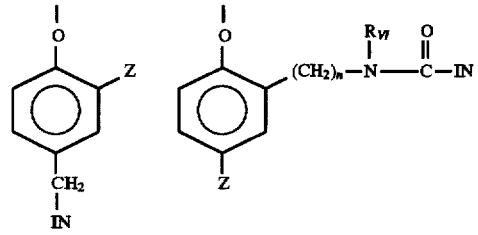

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

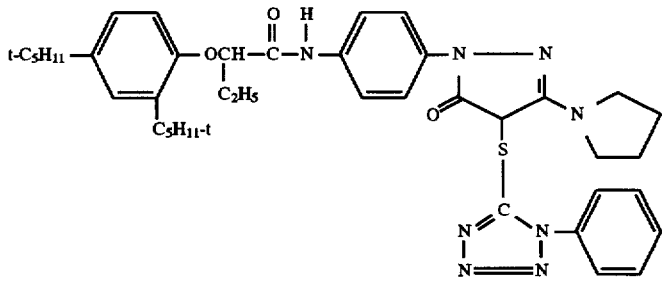

-continued
D2
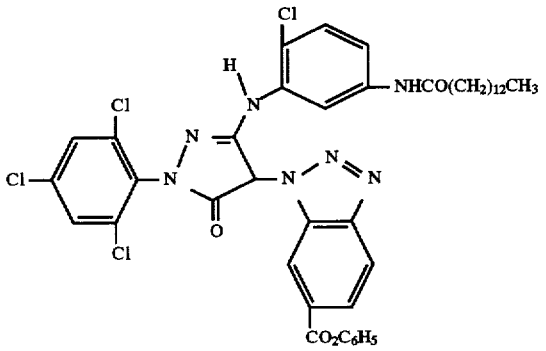
D3
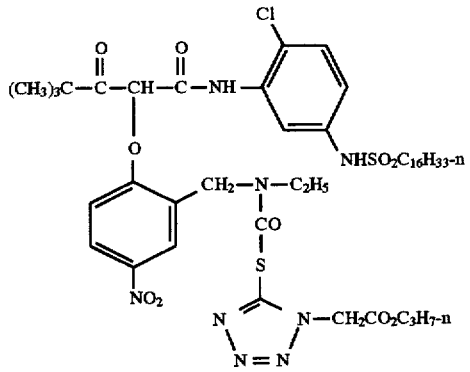
D4
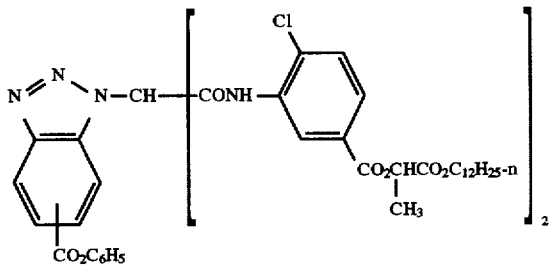
D5
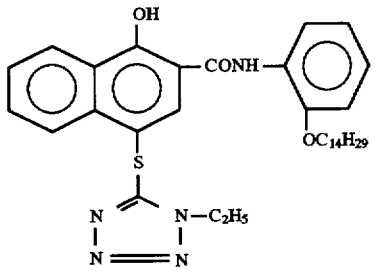
D6
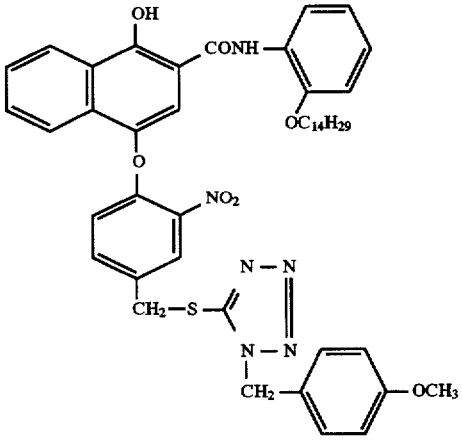
D7
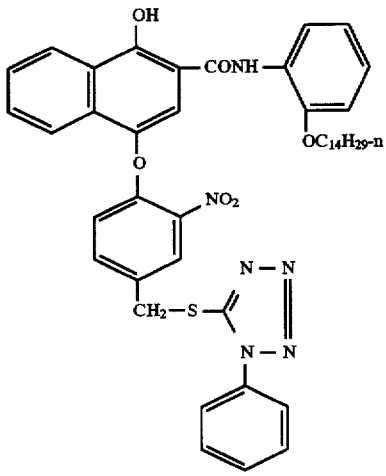
D8
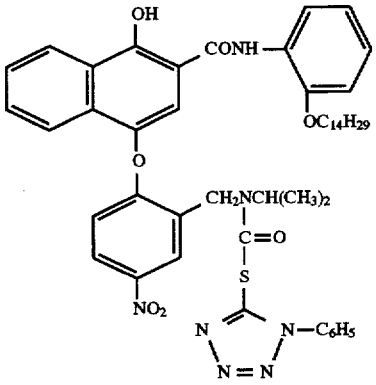
D9
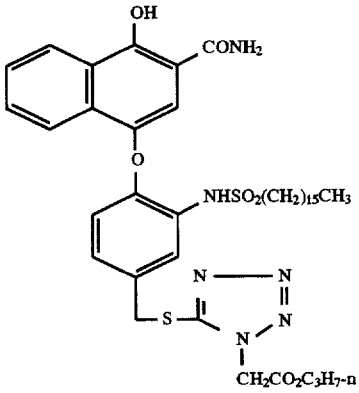

-continued

D10

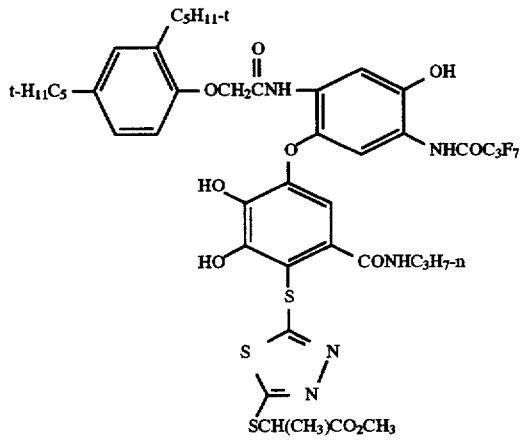

D-11

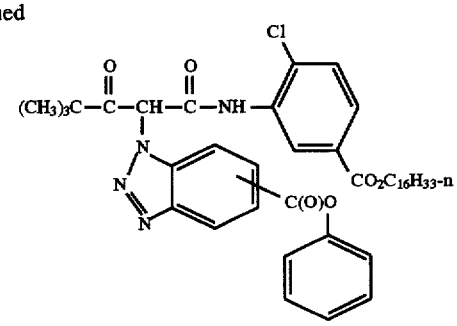

D-12

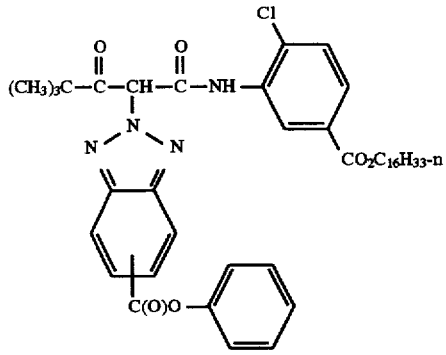

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Such negative working emulsions are typically sold with instructions to process using a color negative method such as the mentioned C-41 process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

The usefulness and advantages of the yellow density correction dyes of this invention and of the color negative films of this invention comprising the yellow density correction dyes and magnetic recording layers of this invention are illustrated by the following Examples, which show the desirable spectral properties of the yellow dyes of this invention and the improved printer compatibility of the color negative films of this invention.

EXAMPLE 1

$D_{min}$ Densities of a Conventional Color Negative Film vs a Color Negative Film Containing a Magnetic Recording Layer and Spectral Comparisons of Density Correction Dyes.

$D_{min}$ spectra were obtained for C-41 processed color negative films coated on a conventional cellulose acetate support and on a polyethylene naphthalate support with a layer of magnetic particles. $D_{min}$ refers to the density areas of processed film samples that received no light exposure. $D_{min}$ densities at 420 nm, 440 nm and 480 nm are compared in Table I for a conventional 200 speed film and a similar film (referred to as Magnetic Film) on polyethylene naphthalate containing magnetic particles. The density differences between the two films are also listed in Table I. It is evident that, while the Dmin densities for the two films are well matched at 480 nm and reasonably well matched at 440 nm, the Magnetic Film has much more density at 420 nm. This will cause some printers to increase blue light exposure through the Magnetic Film, even though color papers with a peak sensitivity near 480 nm would require the same exposure through each film to provide prints having the same color balance. The increased blue exposure of negatives on the Magnetic Film with some color printers will result in prints that are too yellow relative to prints made from conventional color negative films on most color papers.

TABLE I

| Film | $D_{min}$ Density at 420 nm | at 440 nm | at 480 nm |
|---|---|---|---|
| 1 Magnetic Film | 1.01 | 0.99 | 0.81 |
| 2 Conventional 200 speed film | 0.89 | 0.96 | 0.81 |
| Difference (1 – 2) | 0.12 | 0.03 | 0.00 |

The Magnetic Film in this example contains 0.135 g/sq m of the density correction dye C2, having the structure shown below. As shown by the spectral data below, C2 has high absorption at 420 nm relative to the density correction dyes of this invention. Replacing C2 in films such as the Magnetic Film with the dyes of this invention can reduce $D_{min}$ densities at 420 nm relative to 480 nm. This will render the density differences between films with magnetic recording layers and conventional film more similar at 420 and 480 nm. The net result is that prints made from the films with magnetic recording layers will have color balance more similar to prints made from conventional color negatives, even using printers with high sensitivity in the region of 420 nm.

C2

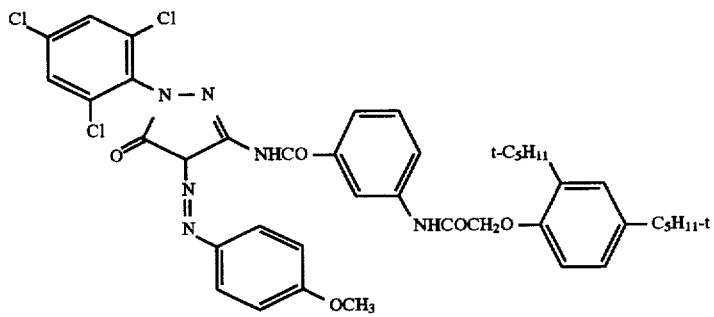

To illustrate the spectral differences of conventional density correction dyes such as C2 and the yellow methine density correction dyes of this invention, single-layer dye coatings were prepared and evaluated. All of the density correction dyes were dispersed and coated together with the high-boiling solvent tritolyl phosphate (S-1) (mixed isomers) at a 1:2 dye to S-1 weight ratio. For example, a dispersion and coating of D1 was prepared as follows. An oil phase consisting of 13.0 g of D1, 26.0 g of S-1 and 39.0 g of ethyl acetate was added to an aqueous phase consisting of 39.0 g of gelatin 3.9 g of a surfactant (sodium tri-isopropylnaphthalene sulfonate) in 529 ml of water. The oil phase was dispersed in the aqueous phase in the form of small particles by passing the mixture through a colloid mill in a manner known in the art. The ethyl acetate auxiliary solvent was removed by evaporation resulting in a dispersion that contained 2.1% by weight of dye D1. A sample of the dispersion of D1 was coated on a transparent cellulose acetate support together with additional gelatin, a spreading agent and formaldehyde hardener at a D1 laydown of about 0.065 g/sq m to provide a transmission optical density at the absorption maximum of about 0.7. Dispersions of the other density correction dyes were prepared similarly, and these dyes were similarly coated at levels sufficient to provide optical densities of approximately 0.7.

After hardening, the coatings were washed for 5 min at 25 C and dried. The dye absorption spectra were measured on a Perkin Elmer Lambda 2S spectrophotometer. Table II provides spectral data for the coating of comparative dye C2 with S-1 as well as for dyes D1, D2, D23, D25 and D26 of this invention coated with S-1. Absorption maxima in nm are listed in Table II as well as density ratios at 480:420 nm, 440:420 nm and 510:480 nm. It is evident from the data in Table II that the dyes of this invention have higher 480:420 nm density ratios than dye C2. When the proper levels of dyes D1, D2, D23, D25 or D26 of this invention are coated to achieve the desired density in the region of 480 nm where most color papers are sensitive, the resulting density in the region of 420 nm will be much lower than with comparative dye C2. This will compensate for the higher absorption in the region of 420 nm due the magnetic particles (and in some cases the support) used with color negative films comprising magnetic recording layers.

TABLE II

| Dye | Absorption Maximum (nm) | D 480 nm / D 420 nm | D 440 nm / D 420 nm | D 510 nm / D 480 nm |
|---|---|---|---|---|
| C2 | 438 | 0.82 | 1.06 | 0.50 |
| D1 | 457 | 1.44 | 1.41 | 0.34 |
| D2 | 456 | 1.29 | 1.30 | 0.35 |
| D23 | 460 | 1.66 | 1.54 | 0.35 |
| D25 | 465 | 2.07 | 1.72 | 0.51 |
| D26 | 466 | 2.16 | 1.80 | 0.46 |

It is also desirable that density correction dyes used with color negative films comprising magnetic recording layers have somewhat higher 440:420 nm density ratios than previously use dyes such as C2, since there is typically only a small density mismatch in the region of 440 nm between conventional color negative Dmin values and Dmin values obtained for color negative films comprising magnetic recording layers (see Table I). In addition to having 480:420 nm ratios that are substantially larger than the value for C2, the density correction dyes of this invention have larger 440:420 nm density ratios, as is evident from the data in Table II. It is also desirable that yellow density correction dyes not have strong absorption at wavelengths longer than about 510 nm, particularly if they are coated above the green and red sensitive layers to filter unwanted blue light. The low 510:480 nm density ratios for preferred density correction dyes of this invention permit their use for filtration of blue light in some instances.

As noted above, the optimum spectral properties for the yellow methine density correction dyes of this invention depend upon the absorption properties of the magnetic particles and the transparent support comprising this invention as well as whether the density correction dyes will also be used to filter blue light during exposure. For most applications it is desirable that 480:420 nm density ratios be between about 1.1 and 3.0, preferably between 1.25 and 2.5. It is also desirable that for most applications 440:420 nm density ratios be between about 1.2 and 2.2, preferably between 1.3 and 2.0. It is also desired that 510:480 nm density ratios be no more than 0.6 and preferably less than 0.55, particularly when the density correction dyes are coated in a filtration layer above the green sensitive layers of a color negative film.

An additional advantage of the density correction dyes of this invention is their relatively high covering power, which allows relatively low levels to be coated. This can reduce film cost and provide thinner films. For example, the covering power of comparative dye C2 in the coating composition of this example is only about 2.8 sq m/g, whereas the covering power values of dyes D1, D2 and D3 of this invention are about 10, 9 and 10 sq m/g, respectively, as coated in this example. This means that only about ⅓ as much D1, D2 or D3 need be coated to achieve the same density as C2.

Another advantage of the yellow methine density correction dyes of this invention is their excellent stability on storage. For example, dye D1 (coated with S-1 at 1:2) undergoes less than 2% density loss after storage for one week at 70 C/50% RH, whereas dye C1 noted earlier looses 50% of its original density (coated with S-1 at 1:2) after storage for one week at 70 C/50% RH.

EXAMPLE 2

Printing Characteristics of a Color Negative Film of this Invention Comprising a Magnetic Recording Layer and Yellow Methine Density Correction Dye D1 of this Invention The multilayer film structure utilized for this example is shown schematically in Table III. Structures of components not provided previously are given immediately following Table III. Component laydowns are provided in units of g/sq m unless otherwise indicated. Gelatin was used as a binder in the various layers of the multilayer film. Film A contains comparative density correction dye C2 at 0.140 g/sq m, of which 0.097 g/sq m is coated in the yellow filter layer between the blue and green sensitive layers and 0.043 g/sq m is coated in the antihalation layer just above the support. Film B contains 0.097 g/sq m of C1 in the yellow filter layer plus 0.011 g/sq m of C2 and 0.027 g/sq m of C1 in the antihalation layer. Film C of this invention contains 0.039 g/sq m of density correction dye D1 of this invention in the yellow filter layer and no yellow density correction dye in the antihalation layer. These films as well as commercially available 200 speed Color Negative Film were given neutral exposures and processed using KODAK FLEXICOLOR C-41 processing chemistry.

The applied magnetic recording layer comprised a transparent polymeric binder, ferromagnetic particles and abrasive particles, the magnetic particles having a surface area greater than 30 $m^2$/gm and a coverage of from about $1\times10^{-11}$ mg/μm3 to about $1\times10^{-11}$ mg/μm3. The abrasive particles had a median diameter of from about 0.2 to about 0.4 μm, specific surface area greater than 5 m2/gm, a Mohs hardness of at least 6 and were present in the transparent magnetic layer in an amount of 30% and upwards by weight based on the weight of the magnetic particles present.

The neutral steps of various density were then printed onto color paper using an AGFA MSP automatic printer that was adjusted to provide optimum color balance for prints made from the 200 speed negatives. The red, green and blue Status A densities of the prints were measured and the densities of the prints made from films A, B and C of Table III were compared to those of the check prints made from the 200 speed negatives. The Status A density differences are given in Tables IV and V for negatives that were normally exposed and overexposed by three stops, respectively. The density deviations are much lower for prints made from film C of this invention. The reduction on the blue density differences for film C are particularly significant and result in prints that are much less yellow than prints made from films B or C, and very similar in color balance to the prints made from the 200 speed check negatives.

TABLE III

| MULTILAYER FILM STRUCTURE | |
|---|---|
| 1 Overcoat Layer: | Matte Beads<br>Gelatin (0.89) |
| 2 UV Protective Layer: | UV Abosrber UV-1 (0.111) & S-4 (0.111)<br>UV Absorber UV-2 (0.1112) & S-4 (0.111)<br>Silver Bromide Lippmann Emulsion (0.215 Ag)<br>Gelatin (0.70) |
| 3 Fast Yellow Layer: | Y-1 (0.150) & S-1 (0.075)<br>IR-1 (0.032) & S-1 (0.016)<br>B-1 (0.0054) & S-3 (0.0070)<br>Blue Sensitive Silver Iodobromide Emulsion (0.430 Ag), 4.5 mole % Iodide Tabular-Grain (2.3 × 0.13 μm)<br>Gelatin (0.753) |
| 4 Slow Yellow Layer: | Y-1 (0.915) & S-1 (0.457)<br>IR-1 (0.032) & S-1 (0.032)<br>B-1 (0.0065) & S-3 (0.0084)<br>Blue Sensitive Silver Iodobromide Emulsion (0.161 Ag), 4.5 mole % Iodide Tabular-Grain (1.4 × 0.13 μm)<br>Blue Sensitive Silver Iodobromide Emulsion (0.108 Ag), 1.5 mole % Iodide Tabular-Grain (0.85 × 0.13 μm)<br>Blue Sensitive Silver Iodobromide Emulsion (0.161 Ag), 1.3 mole % Iodide Tabular-Grain (0.54 × 0.09 μm)<br>Gelatin (1.668)<br>Bis(vinylsulfonyl)methane Hardener at 1.8% by weight of total Gelatin |
| 5 Yellow Filter Layer: | R-1 (0.075) & S-2 (0.121) & ST-2 (0.010)<br>YD-2 (0.108)<br>Gelatin (0.861) & A C2 (0.097) or B C2 (0.097) or C D1 (0.039) & S-1 (0.078) |
| 6 Fast Magenta Layer: | M-1 (0.052) & S-1 (0.047) & ST-1 (0.005)<br>MM-1 (0.027) & S-1 (0.054)<br>IR-2 (0.016) & S-2 (0.032)<br>Green Sensitive Silver Iodobromide Emulsion (0.699 Ag), 4.5 mole % Iodide Tabular-Grain (0.98 × 0.11 μm)<br>Gelatin (1.12) |
| 7 Mid Magenta Layer: | M-1 (0.099) & S-1 (0.089) & ST-1 (0.010)<br>MM-1 (0.032) & S-1 (0.064)<br>IR-2 (0.022) & S-2 (0.044)<br>Green Sensitive Silver Iodobromide Emulsion (0.646 Ag), 4.5 mole % Iodide Tabular Grain (0.61 × 0.12 μm)<br>Gelatin (1.41) |
| 8 Slow Magenta Layer: | M-1 (0.0204) & S-1 (0.184) & ST-1 (0.020)<br>MM-1 (0.038) & S-1 (0.076)<br>Green Sensitive Silver Iodobromide Emulsion (0.258 Ag), 1.5 mole % Iodide Tabular Grain (0.70 × 0.11 μm)<br>Green Sensitive Silver Iodobromide Emulsion (0.409 Ag), 1.3 mole % Iodide Tabular Grain (0.54 × 0.09 μm)<br>Gelatin (1.18) |
| 9 Interlayer: | R-1 (0.075) & S-6 (0.113)<br>Gelatin (0.86) |
| 10 Fast Cyan Layer: | CC-1 (0.161) & S-2 (0.161)<br>CM-1 (0.032)<br>IR-3 (0.038) DIAR & S-5 (0.038)<br>IR-4 (0.038) DIAR & S-2 (0.076)<br>Red Sensitive Silver Iodobromide Emulsion (1.08 Ag), 4.5 mole % Iodide Tabular Grain (1.10 × 0.11 μm)<br>Gelatin (1.45) |
| 11 Mid Cyan Layer: | CC-1 (0.183) & S-2 (0.183)<br>CM-1 (0.011)<br>B-1 (0.027) & S-3 (0.035)<br>IR-3 (0.054) & S-5 (0.054)<br>Red Sensitive Silver Iodobromide Emulsion (0.215 Ag), 4.5 mole % Iodide Tabular-Grain (0.98 × 0.11 μm)<br>Red Sensitive Silver Iodobromide Emulsion (0.861 Ag), 3.3 mole % Iodide Cubic (0.49 μm)<br>Gelatin (1.35) |
| 12 Slow Cyan Layer: | CC-1 (0.355) & S-2 (0.355) |

TABLE III-continued

| MULTILAYER FILM STRUCTURE | |
|---|---|
| | IR-4 (0.011) & S-2 (0.022) |
| | B-1 (0.075) & S-3 (0.098) |
| | Red Sensitive Silver Iodobromide Emulsion (0.387 Ag), 3.3 mole % Iodide Cubic (0.32 μm) |
| | Gelatin (1.64) |
| 13 Interlayer: | R-1 (0.075) & S-6 (0.113) |
| | Gelatin (0.86) |
| 14 Antihalation Layer: | Grey Silver (0.15 Ag), CD-1 (0.0075), MD-1 (0.032) |
| | S-1, S-6 (0.323), Gelatin (1.61) & |
| | A C2 (0.043), or |
| | B C2 (0.011) & C1 (0.027) & S-1 (0.054), or |
| | C No additional yellow density correction dye in AHU |
| Polyethylene Naphthalate Support with Magnetic Recording Layer | |

S-1

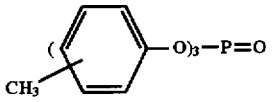

mixed isomers

S-2

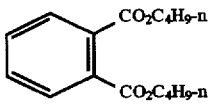

S-3

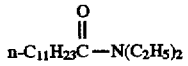

S-4

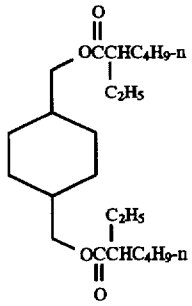

S-5

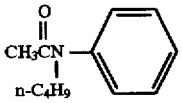

S-6

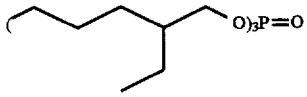

UV-1

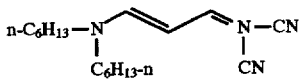

UV-2

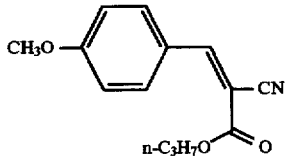

-continued
Y-1
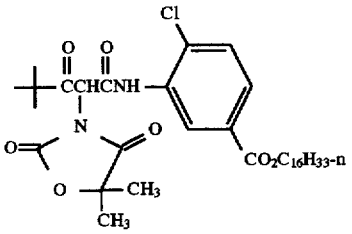
IR-1
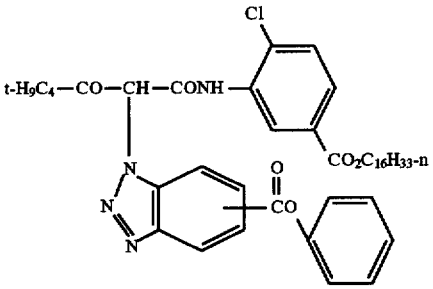
YD-2
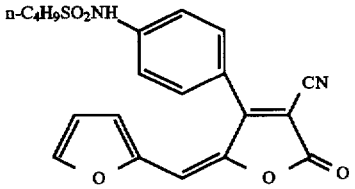
ST-1
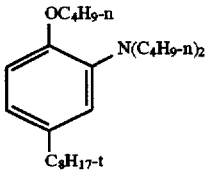
ST-2
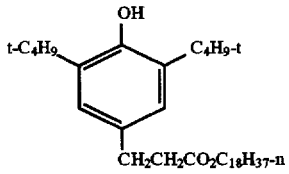
R-1
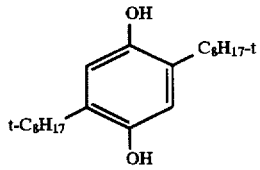
M-1
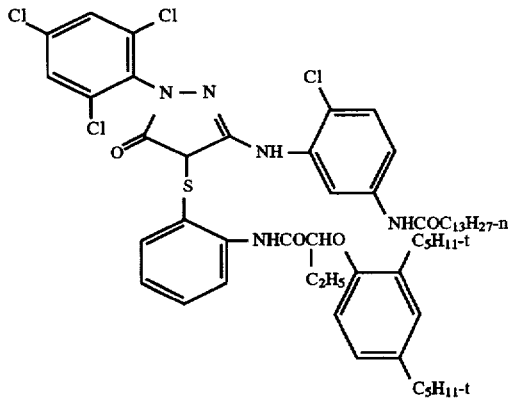

-continued
MM-1
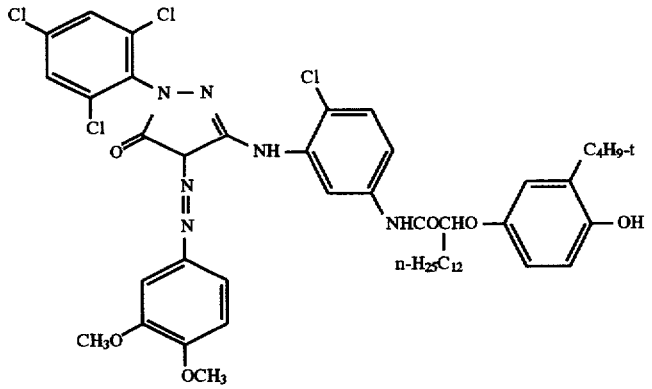
CC-1
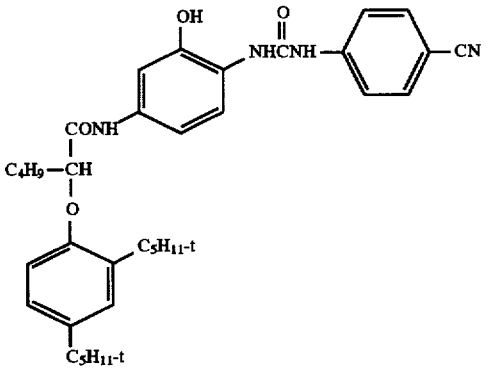
CM-1
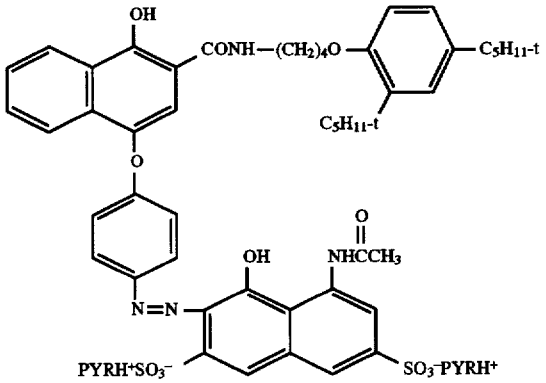
IR-2
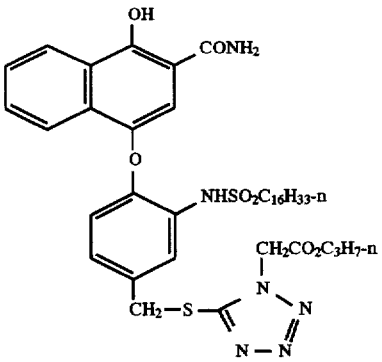

-continued
IR-3
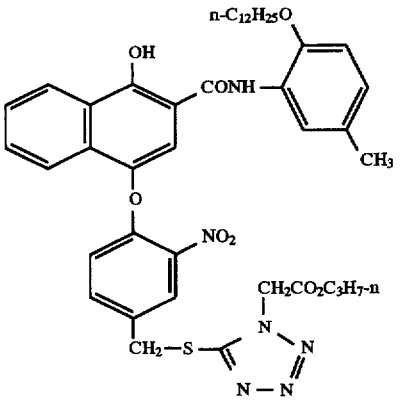
IR-4
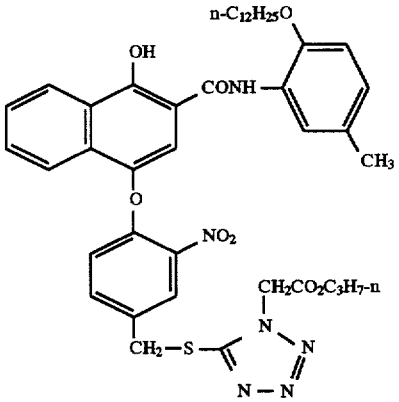
B-1
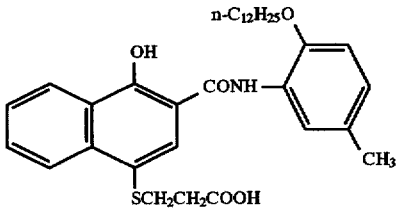
CD-1
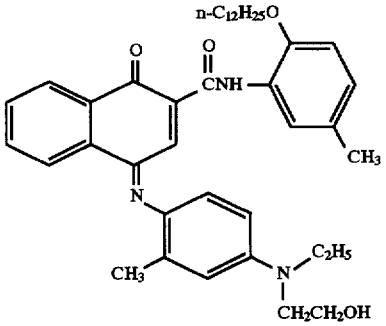

-continued

CD-2

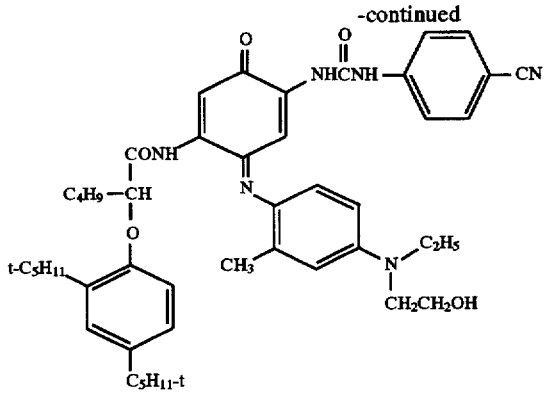

MD-1

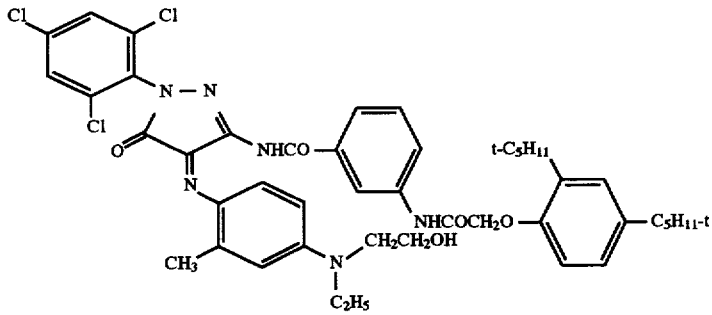

TABLE IV

| Status A Density Differences vs Prints from Commercial 200 Speed Film at Normal Exposure | | | |
|---|---|---|---|
| Multilayer Film | Red | Green | Blue |
| A (Comparative) | −0.04 | 0.00 | 0.07 |
| B (Comparative) | −0.03 | 0.00 | 0.03 |
| C (Invention) | −0.02 | 0.01 | 0.00 |

TABLE V

| Status A Density Differences vs Prints from 200 speed at 3 Stops Overexposure | | | |
|---|---|---|---|
| Multilayer Film | Red | Green | Blue |
| A (Comparative) | −0.01 | 0.00 | 0.09 |
| B (Comparative) | −0.02 | 0.00 | 0.06 |
| C (Invention) | 0.00 | 0.00 | 0.03 |

EXAMPLE 3

Printing Characteristics of Color Negative Films of this Invention Comprising a Magnetic Recording Layer and Yellow Methine Density Correction Dyes D1 and D23 of this Invention in the AHU.

Another set of multilayer films was prepared that included a comparative film and films containing density correction dyes D1 or D23 of this invention. The multilayer films were coated on the same support and with the same magnetic recording layer as the films of Example 2. The coating structure of these films is similar to that of Example 2, except that the yellow filter layer (5) is as shown in Table VI, below, and the antihalation layer (14) varies as also shown in Table VI. Comparative film D contains 0.151 g/sq m of density correction dye C2 in the antihalation layer, whereas film E of this invention contains 0.038 g/sq m of dye D1 in the antihalation layer and film F of this invention contains 0.037 g/sq m of density correction dye D23 in the antihalation layer. These films as well as the commercially available 200 speed color negative Film were given neutral exposures and processed using KODAK FLEXICOLOR C-41 processing chemistry.

The neutral steps of various density were then printed onto color paper using an AGFA MSP automatic printer that was adjusted to provide optimum color balance for prints made from the 200 speed negatives. The red, green and blue Status A densities of the prints were measured and the densities of the prints made from films D, E and F of Table VI were compared to those of the check prints made from the 200 speed negatives. The Status A density differences are given in Table VII for negatives given a normal neutral exposure. It is evident that the density deviations are much lower for prints made from film E and F of this invention. The reductions in the blue density differences for prints from films E and F are particularly significant and result in prints that are much less yellow than those made from film D and very similar in color balance to prints made from the 200 speed check negatives.

TABLE VI

| | |
|---|---|
| 5 Yellow Filter Layer: | R-1 (0.075) & S-2 (0.121) & ST-2 (0.010)<br>YD-2 (0.161)<br>Gelatin (0.861) |
| 14 Antihalation Layer: | Grey Silver (0.15 Ag), CD-1 (0.0075), MD-1 (0.032)<br>S-1, S-6 (0.323), Gelatin (1.61)<br>& D C2 (0.151)<br>or E D1 (0.038) & (0.076) S-1<br>or F D23 (0.037) & (0.148) S-1 |

TABLE VII

| Status A Density Differences vs Prints from 200 speed color negative film at Normal Exposure | | | |
|---|---|---|---|
| Multilayer Film | Red | Green | Blue |
| D (Comparative) | −0.02 | 0.00 | 0.07 |
| E (Invention) | 0.00 | −0.01 | 0.01 |
| F (Invention) | 0.00 | 0.00 | −0.01 |

EXAMPLE 4

Printing Characteristics of Color Negative Films of this Invention Comprising a Magnetic Recording Layer and Yellow Methine Density Correction Dye D23 of this Invention Another set of multilayer films was prepared that included a comparative film and films containing density correction dye D23 of this invention. The multilayer films were coated on the same support and with the same magnetic recording layer as the films of Example 2 with a similar coating structure, as shown in Table VIII. Comparative film G contains 0.097 g/sq m of C2 in the yellow filter layer and 0.043 g/sq m of C2 in the antihalation layer (14). Film H of this invention contains dye D23 in the antihalation layer at 0.0365 g/sq m and film I of this invention contains 0.0365 g/sq m of dye D23 in the slow magenta layer (8). These films as well as commercially available 200 speed color negative film were given neutral exposures and processed using KODAK FLEXICOLOR C-41 processing chemistry.

The neutral steps of various density were then printed onto color print paper using an AGFA MSP automatic printer that was adjusted to provide optimum color balance for prints made from the 200 speed negatives. The red, green and blue Status A densities of the prints were measured and the densities of the prints made from films G, H and I of Table VIII were compared to those of the check prints made from the 200 speed negatives. The Status A density differences are given in Table IX for negatives given a normal neutral exposure. It is evident that the density deviations are much lower for prints made from films H and I of this invention. The reduction in the blue density differences for prints from films H and I are particularly significant and result in prints that, rather than being yellow like those from film G, are very similar in color balance to the prints made from the 200 speed check negatives.

TABLE VIII

| MULTILAYER FILM STRUCTURE | |
|---|---|
| 1 Overcoat Layer: | Matte Beads<br>Gelatin (0.89) |
| 2 UV Protective Layer: | UV Absorber UV-1 (0.111) & S-4 (0.111)<br>UV Absorber UV-2 (0.111) & S-4 (0.111)<br>Silver Bromide Lippmann Emulsion (0.215 Ag)<br>Gelatin (0.70) |
| 3 Fast Yellow Layer: | Y-1 (0.150) & S-1 (0.075)<br>IR-1 (0.032) & S-1 (0.016)<br>B-1 (0.0054) & S-3 (0.0070)<br>Blue Sensitive Silver Iodobromide Emulsion (0.430 Ag), 4.5 mole % Iodide Tabular-Grain (2.3 × 0.13 μm)<br>Gelatin (0.753) |
| 4 Slow Yellow Layer: | Y-1 (0.915) & S-1 (0.457)<br>IR-1 (0.032) & S-1 (0.016)<br>B-1 (0.0065) & S-3 (0.0084)<br>Blue Sensitive Silver Iodobromide Emulsion (0.178 Ag), 4.5 mole % Iodide Tabular-Grain (1.4 × 0.13 μm)<br>Blue Sensitive Silver Iodobromide Emulsion (0.118 Ag), 1.5 mole % Iodide Tabular-Grain (0.85 × 0.13 μm)<br>Blue Sensitive Silver Iodobromide Emulsion (0.178 Ag), 1.3 mole % Iodide Tabular-Grain (0.54 × 0.09 μm)<br>Gelatin (1.668)<br>Bis(vinylsulfonyl)methane Hardener at 1.8% by weight of total Gelatin |
| 5 Yellow Filter Layer: | R-1 (0.075) & S-2 (0.121) & ST-2 (0.010)<br>Gelatin (0.861)<br>&<br>G C2 (0.097) & YD-2 Filter Dye (0.108)<br>or H No yellow density correction dye & YD-2 (0.161)<br>or I No yellow density correction dye & YD-2 (0.161) |
| 6 Fast Magenta Layer: | M-1 (0.059) & S-1 (0.053) & ST-1 (0.006) Addendum<br>MM-1 (0.027) & S-1 (0.054)<br>IR-2 (0.016) & S-2 (0.032)<br>Green Sensitive Silver Iodobromide Emulsion (0.699 Ag), 4.5 mole % Iodide Tabular-Grain (0.98 × 0.11 μm)<br>Gelatin (1.22) |
| 7 Mid Magenta Layer: | M-1 (0.124) & S-1 (0.111) & ST-1 (0.012)<br>MM-1 (0.032) & S-1 (0.064)<br>IR-2 (0.022) & S-2 (0.044)<br>Geeen Sensitive Silver Iodobromide Emulsion (0.646 Ag), 4.5 mole % Iodide Tabular Grain (0.61 × 0.12 μm)<br>Gelatin (1.41) |
| 8 Slow Magenta layer: | M-1 (0.172) & S-1 (0.155) & ST-1 (0.017)<br>MM-1 (0.038) & S-1 (0.076) |

TABLE VIII-continued

| MULTILAYER FILM STRUCTURE | |
|---|---|
| | Green Sensitive Silver Iodobromide Emulsion (0.377 Ag), 3.3 mole % Iodide Cubic (0.275 μm)<br>Green Sensitive Silver Iodobromide Emulsion (0.108 Ag), 1.3 mole % Iodide Tabular Grain (0.54 × 0.09 μm)<br>Gelatin (1.18)<br>&<br>G No yellow density correction dye<br>or H No yellow density correction dye<br>or I D23 (0.0365) + S1 (0.146) |
| 9 Interlayer: | R-1 (0.075) & S-6 (0.113)<br>Gelatin (0.86) |
| 10 Fast Cyan Layer: | CC-1 (0.172) & S-2 (0.172)<br>CM-1 (0.032)<br>IR-3 (0.038) & S-5 (0.076)<br>IR-4 (0.038) & S-2 (0.076)<br>Red Sensitive Silver Iodobromide Emulsion (0.968 Ag), 4.5 mole % Iodide Tabular-Grain (1.10 × 0.11 μm)<br>Gelatin (1.45) |
| 11 Mid Cyan Layer: | CC-1 (0.183) & S-2 (0.183)<br>CM-1 (0.011)<br>B-1 (0.027) & S-3 (0.035)<br>IR-3 (0.054) & S-5 (0.108)<br>Red Sensitive Silver Iodobromide Emulsion (0.215 Ag), 4.5 mole % Iodide Tabular-Grain (0.98 × 0.11 μm)<br>Red Sensitive Silver Iodobromide Emulsion (0.861 Ag), 3.3 mole % Iodide Cubic (0.49 μm)<br>Gelatin (1.35) |
| 12 Slow Cyan Layer: | CC-1 (0.355) & S-2 (0.355)<br>IR-4 (0.011) & S-2 (0.022)<br>B-1 (0.075) & S-3 (0.098)<br>Red Sensitive Silver Iodobromide Emulsion (0.387 Ag), 3.3 mole % Iodide Cubic (0.32 μm)<br>Gelatin (1.64) |
| 13 Interlayer: | R-1 (0.075) & S-6 (0.113)<br>Gelatin (0.86) |
| 14 Antihalation Layer: | Grey Silver (0.15 Ag), CD-2 (0.0075), MD-1 (0.038)<br>R-1 (0.108), S-1, S-2, S-6 (.161), Gelatin (1.61)<br>&<br>G C2 (0.043)<br>or H D23 (0.0365) and S-1 (0.146)<br>or I No additional yellow density correction dye in AHU |
| Polyethylene Naphthalate Support with Magnetic Recording Layer | |

TABLE IX

| Status A Density Differences vs Prints from conventional 200 speed negative film at Normal Exposure | | | |
|---|---|---|---|
| Multilayer Film | Red | Green | Blue |
| G (Comparative) | −0.02 | 0.00 | 0.09 |
| H (Invention) | 0.00 | 0.01 | 0.00 |
| I (Invention) | 0.00 | 0.00 | 0.00 |

The preceding examples are set forth to illustrate specific embodiments of this invention and are not intended to limit the scope of the compositions or materials of the invention. Additional embodiments and advantages within the scope of the claimed invention will be apparent to one skilled in the art.

What is claimed is:

1. A multilayer color negative photographic element comprising a support, at least one light-sensitive silver halide layer sensitive to each of the blue, green and red regions of the visible spectrum, a magnetic recording layer and a yellow or orange-yellow methine density correction dye of structure I,

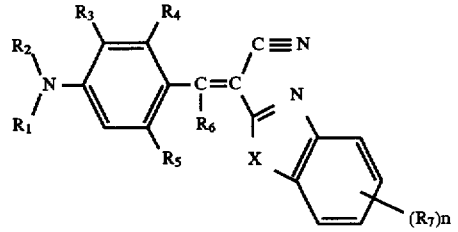

I wherein:

$R_1$ is hydrogen or an alkyl group;

$R_2$ is an alkyl group or an aryl group;

$R_3$ is hydrogen, a halogen atom, an alkyl group, an alkoxy group or an aryloxy group;

$R_4$ is hydrogen or an alkyl group;

$R_5$ is hydrogen or an alkyl group;

$R_6$ is hydrogen or an alkyl group;

X is oxygen or sulfur;

each $R_7$ is independently a substituent selected from the group consisting of a halogen atom, and alkyl, aryl, alkoxy, aryloxy, carbonamido, sulfonamido, carbamoyl, alkoxycarbonyl, aryloxycarbonyl and acyloxy, acyl, sulfamoyl, sulfonyl, sulfoxyl, alkylthio, arylthio and cyano groups;

n is 0, 1, 2 or 3; and $R_1$ and $R_2$ or $R_2$ and $R_3$ may join to form a ring.

2. A color negative element according to claim 1, wherein the magnetic recording layer comprises ferromagnetic particles having a size of at least 20 sq m/g and coated at a level of from $1\times10^4$ to $2\times10^5$ g/m$^3$.

3. A color negative element according to claim 1, wherein the ferromagnetic particles comprise iron oxides, iron oxides surface treated with other metals, chromium dioxides, chromium dioxides with other metals in solid solution, or barium ferrites.

4. A color negative element according to claim 3, wherein the ferromagnetic particles comprise cobalt surface-treated gamma iron oxide.

5. A color negative element according to claim 1, wherein the methine dye has a spectral absorption maximum in the range of 450–480 nm as coated in the element.

6. A color negative element according to claim 5, wherein the methine dye has a spectral absorption maximum in the range of 455–475 nm as coated in the element.

7. A color negative element according to claim 1, wherein the methine density correction dye provides a density ratio at 480 nm relative to 420 nm of 1.1 to 3.0, a density ratio at 440 nm relative to 420 nm of 1.2 to 2.2 and a density ratio at 510 nm relative to 480 nm of less than 0.6.

8. A color negative element according to claim 7, wherein the methine density correction dye provides a density ratio at 480 nm relative to 420 nm of 1.25 to 2.5, a density ratio at 440 nm relative to 420 nm of 1.3 to 2.0 and a density ratio at 510 nm relative to 480 nm of less than 0.55.

9. A color negative element according to claim 1, wherein the methine density correction dye is coated at a level of from 0.005 to 0.160 g/sq m.

10. A color negative element according to claim 9, wherein the methine density correction dye is coated at a level of from 0.011 to 0.11 g/sq m.

11. A color negative element according to claim 1, wherein the total number of carbon atoms in $R_1$ through $R_7$ is at least 8.

12. A color negative element according to claim 11, wherein the total number of carbon atoms in $R_1$ through $R_7$ is at least 10.

13. A color negative element according to claim 1, wherein the methine density correction dye does not contain charged groups, carboxyl groups or sulfonate groups.

14. A color negative element according to claim 1, wherein the magnetic recording particles are coated at a level of from 0.01 to 0.25 g/sq m.

15. A color negative element according to claim 14, wherein the magnetic recording particles are coated at a level of from 0.02 to 0.08 g/sq m.

16. A color negative element according to claim 1, wherein the methine density correction dye is dispersed together with a high-boiling solvent at a dye:solvent weight ratio of from 0.1 to 10.0.

17. A color negative element according to claim 1, wherein the methine density correction dye is coated as a dispersion prepared without the use of a removable auxiliary solvent.

18. A color negative element according to claim 1, wherein the support is selected from the group consisting of polyethylene naphthalate, polyethylene terephthalate and cellulose triacetate.

19. A color negative element according to claim 1, wherein $R_4$ is hydrogen.

20. A color negative element according to claim 1, wherein X is oxygen.

21. A color negative element according to claim 1, wherein $R_5$ is an alkyl group.

22. A color negative element according to claim 1, wherein $R_6$ is hydrogen.

23. A color negative element according to claim 1, wherein $R_2$ is an alkyl group.

24. A color negative element according to claim 1, wherein $R_1$ is hydrogen, $R_2$ is alkyl, $R_3$ is hydrogen or alkyl, $R_4$ is hydrogen, $R_5$ is alkyl, $R_6$ is hydrogen, X is oxygen, n is 0 or 1 and, when n is 1, $R_7$ is an alkyl group, a sulfonamido group or a halogen in the para position relative to X.

25. A color negative element according to claim 1, wherein $R_1$ and $R_2$ are alkyl groups, $R_3$, $R_4$ and $R_6$ are hydrogen, $R_5$ is an alkyl group, X is oxygen, n is 0 or 1 and, when n is 1, $R_7$ an alkyl group, a sulfonamido group or a halogen in the para position relative to X.

26. A color negative element according to claim 1, wherein the methine density correction dye is selected from the group consisting of the following:

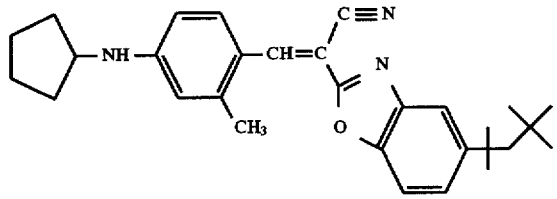

D1

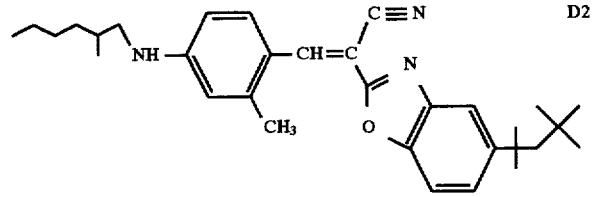

D2

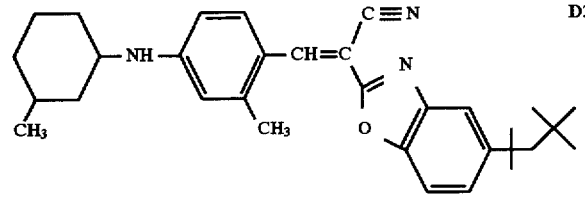

D3

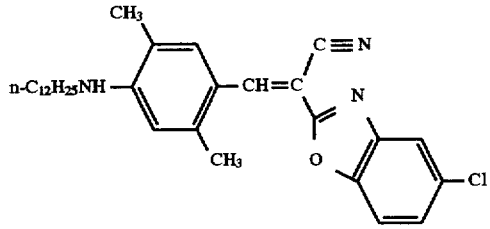

D4

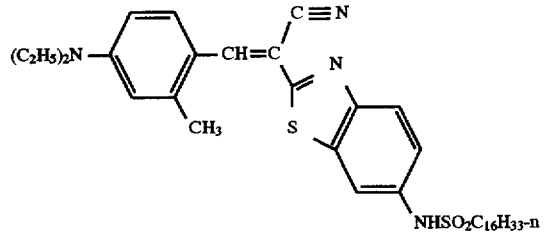

D6

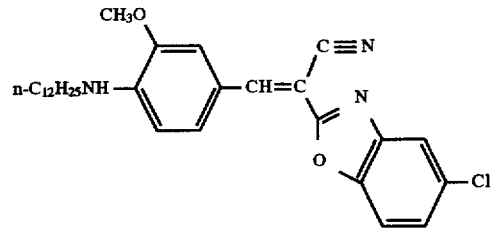

D7

-continued

D8

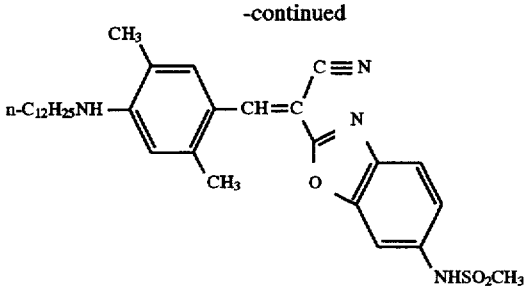

D11

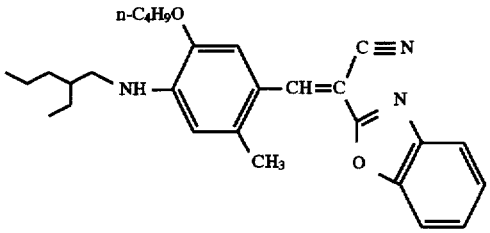

D23

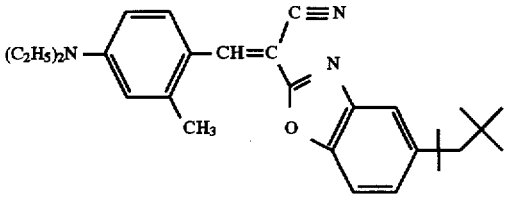

D24

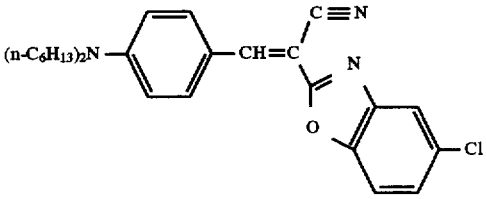

D25

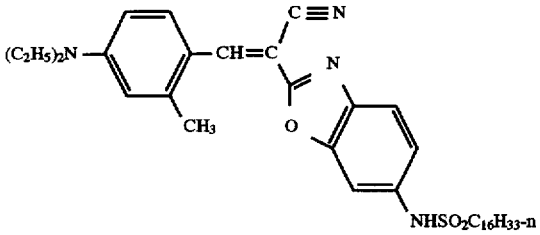

-continued

D26

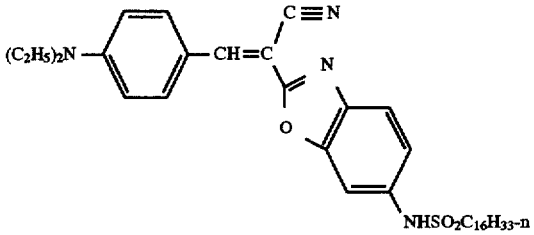

D29

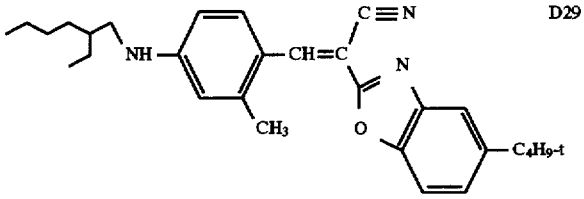

and

D30

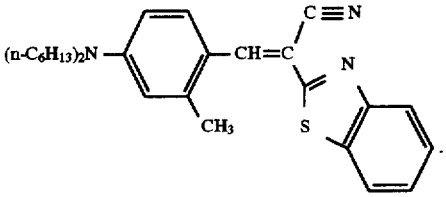

27. A color negative element according to claim 1, wherein the density correction dye is coated in the antihalation layer.

28. A color negative element according to claim 1, wherein the density correction dye is coated in a filtration layer between blue and green-sensitive layers.

29. A color negative element according to claim 1, wherein the density correction dye is coated in the lowest sensitivity green-sensitive layer.

* * * * *